US009955836B2

(12) United States Patent
Puri et al.

(10) Patent No.: US 9,955,836 B2
(45) Date of Patent: May 1, 2018

(54) REFUSE HOLDER AND VACUUM CLEANER INCORPORATING A REFUSE HOLDER

(75) Inventors: Krishan Kumar Puri, Richmond (CA); Kevin Kumar Puri, Richmond (CA); Henry Rhodes, Surrey (CA); Michael Wall, Salt Spring Island (CA)

(73) Assignee: Citywide Machine Wholesale Inc., Richmond (CA)

( * ) Notice: Subject to any disclaimer, the term of this patent is extended or adjusted under 35 U.S.C. 154(b) by 660 days.

(21) Appl. No.: 14/380,617

(22) PCT Filed: Feb. 22, 2012

(86) PCT No.: PCT/CA2012/000162

§ 371 (c)(1),
(2), (4) Date: Sep. 16, 2014

(87) PCT Pub. No.: WO2013/123568

PCT Pub. Date: Aug. 29, 2013

(65) Prior Publication Data

US 2015/0033497 A1 Feb. 5, 2015

(51) Int. Cl.
*A47L 9/10* (2006.01)
*A47L 9/20* (2006.01)
(Continued)

(52) U.S. Cl.
CPC ..... *A47L 9/10* (2013.01); *A47L 9/106* (2013.01); *A47L 9/165* (2013.01); *A47L 9/1608* (2013.01);
(Continued)

(58) Field of Classification Search
CPC ..... A47L 9/10; A47L 9/1608; A47L 9/2836; A47L 9/106; A47L 9/1666; A47L 9/165;
(Continued)

(56) References Cited

U.S. PATENT DOCUMENTS

2007/0157415 A1* 7/2007 Lee ..... A47L 5/225 15/319
2008/0092326 A1 4/2008 Morishita
(Continued)

FOREIGN PATENT DOCUMENTS

DE 10 2009 041 728 A1 6/2010
EP 1 136 028 A2 9/2001
(Continued)

OTHER PUBLICATIONS

International Preliminary Report on Patentability with Annexes for PCT/CA2012/000162, dated Jul. 7, 2014, 11 pages.

*Primary Examiner* — David Redding
(74) *Attorney, Agent, or Firm* — Lewis Roca Rothgerber Christie LLP

(57) ABSTRACT

A refuse holder for holding refuse in a vacuum cleaner is provided. The refuse holder comprises a collector unit for collection of refuse from air entrained with refuse as the air is moved through the collector unit via air inlet means and air outlet means on configuration of the refuse holder in a vacuuming mode, wherein collector unit retains the refuse as a batch of collected refuse. The refuse holder further comprises a storage unit connectable to the collector unit by outlet means for storage of a plurality of batches of collected refuse from the collector unit, each batch being transferrable to the storage unit on configuration of the refuse holder in a refuse transfer mode. The refuse hold further comprises means for switching the configuration of the refuse holder between vacuuming mode and refuse transfer mode. A vacuum cleaner incorporating the refuse holder is also provided.

18 Claims, 8 Drawing Sheets

(51) Int. Cl.
*A47L 9/16* (2006.01)
*A47L 9/28* (2006.01)

(52) U.S. Cl.
CPC ..... *A47L 9/1625* (2013.01); *A47L 9/1641* (2013.01); *A47L 9/1666* (2013.01); *A47L 9/20* (2013.01); *A47L 9/2805* (2013.01); *A47L 9/2836* (2013.01)

(58) Field of Classification Search
CPC .... A47L 9/1641; A47L 9/1625; A47L 9/2805; A47L 9/20
See application file for complete search history.

(56) References Cited

U.S. PATENT DOCUMENTS

| | | | | |
|---|---|---|---|---|
| 2010/0229332 | A1 | 9/2010 | Kang | |
| 2013/0031744 | A1* | 2/2013 | Ota | A47L 9/106 15/348 |

FOREIGN PATENT DOCUMENTS

| | | | |
|---|---|---|---|
| EP | 1 987 759 | A2 | 11/2008 |
| JP | 57-71619 | | 5/1982 |
| WO | WO 2012/009782 | A1 | 1/2012 |

* cited by examiner

REFUSE HOLDER AND VACUUM CLEANER INCORPORATING A REFUSE HOLDER

CROSS-REFERENCE TO RELATED APPLICATIONS

This application is a National Phase patent application and claims priority to and the benefit of International Application Number PCT/CA2012/000162, filed on Feb. 22, 2012, the entire disclosure of which is incorporated herein by reference.

BACKGROUND OF THE INVENTION

1. Field of Invention

This invention relates generally to equipment for holding refuse, and more particularly to a refuse holder for a vacuum cleaner.

2. Description of Related Art

In numerous applications, it may be desirable to hold refuse in a refuse holder. For example, known vacuum cleaners may employ air-permeable bags for holding refuse, or may use one of many known bagless arrangements to hold refuse collected by the vacuum cleaner.

However, known refuse holders, whether they use bags or are of the bagless type, have certain disadvantages. For example, both bagged and bagless arrangements can collect bacteria, germs, and mold, which may grow in stored refuse and be circulated into ambient air during operation of the vacuum cleaner. Also, in these bagged or bagless arrangements, the bag or other collection chamber is often the only place where refuse can be collected, and therefore the refuse holding capacity of the vacuum cleaner is limited by the size of the bag or other collection chamber. In such arrangements, frequent disposal of collected refuse may thus be undesirably required. Furthermore, vacuum cleaners that employ air-permeable bags will generally require periodic replacement of the bags, and replacing these bags can be costly, inconvenient, and disorderly, as loose dust and other refuse particles collected in the bag can become airborne or fall out of the bag during replacement. Also, these air-permeable bag arrangements often require airflow through the air-permeable bag for operation of the vacuum cleaner, and this airflow and the overall effectiveness of the vacuum cleaner may diminish as refuse accumulates in the bag. Even in bagless arrangements, overall effectiveness may be reduced as more refuse is collected.

Known bagless arrangements for vacuum cleaners can overcome some of these disadvantages, although many conventional bagless arrangements include refuse holders that simply collect loose refuse, disadvantageously allowing loose dust or other refuse particles to become airborne or to fall from the refuse holder when the refuse holder is removed from the vacuum cleaner to be emptied, for example.

SUMMARY OF THE INVENTION

Accordingly, an embodiment of the present invention provides a refuse holder for holding refuse in a vacuum cleaner, the refuse holder comprising:

a collector unit for collection of refuse from air entrained with refuse as the air is moved through the collector unit via air inlet means and air outlet means on configuration of the refuse holder in a vacuuming mode, said collector unit retaining the refuse as a batch of collected refuse;

a storage unit connectable to the collector unit by outlet means for storage of a plurality of batches of collected refuse from the collector unit, each batch being transferrable to the storage unit on configuration of the refuse holder in a refuse transfer mode; and means for switching the configuration of the refuse holder between vacuuming mode and refuse transfer mode.

There is also provided a refuse holder for holding refuse in a vacuum cleaner, the refuse holder comprising:

a collector unit including:

a first inner wall;

an outer wall surrounding the inner wall; and an end wall extending between the inner and outer walls;

wherein at least one of the first inner wall, the outer wall, and the end wall defines a first air inlet for receiving air entrained with refuse, said collector unit being adapted to collect said refuse as a batch of collected refuse when the refuse holder is in a vacuuming mode;

wherein at least one of the first inner wall, the outer wall, and the end wall, defines a refuse outlet for removing the air from the collector unit when the refuse holder is in the vacuuming mode;

wherein at least one of the first inner wall, the outer wall, and the end wall, defines a refuse outlet for removing the batch of collected refuse from the collector unit when the refuse holder is in a refuse transfer mode;

a storage unit in communication with the refuse outlet for receiving the batch of collected refuse from the collector unit when the refuse holder is in the refuse transfer mode, and being adapted for storing a plurality of batches of collected refuse; and means for switching the refuse holder between the vacuuming mode and the refuse transfer mode.

The refuse holder can be incorporated in a vacuum cleaner.

In a further aspect, there is provided a method of operating a vacuum cleaner incorporating an embodiment of the refuse holder.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
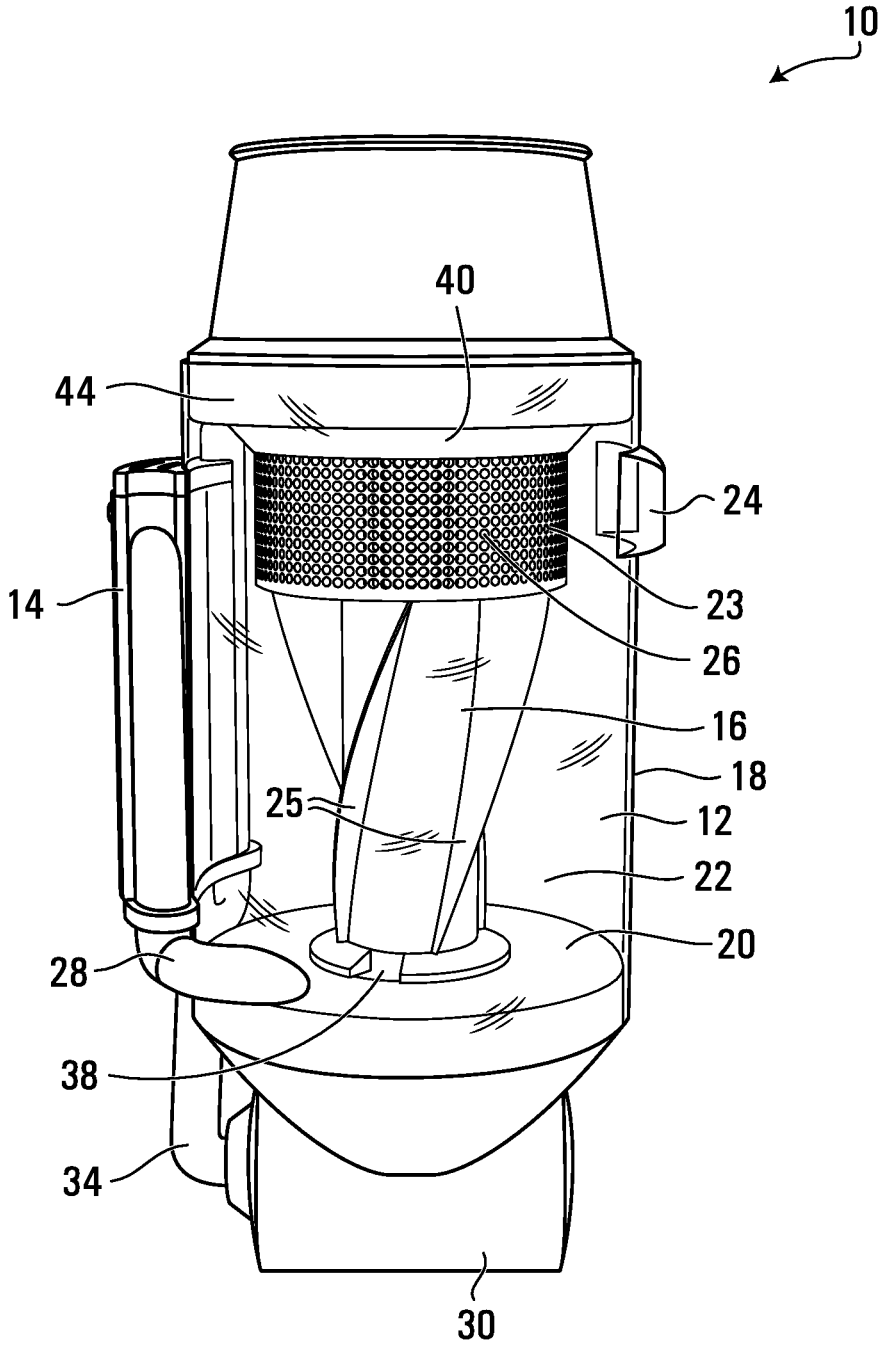
FIG. 1 is a front view of a refuse holder for holding refuse in a vacuum cleaner according to a first embodiment of the invention, showing a scraper in a first position.

Referring to FIG. 1, a refuse holder for holding and storing refuse in a vacuum cleaner in accordance with a first embodiment of the invention is shown generally at 10. Although refuse holder 10 is illustrated as for use with an upright vacuum cleaner, refuse holder 10 may alternatively be for use with a canister-type vacuum cleaner or hand-held vacuum cleaner, for example. The vacuum cleaner may include components of a conventional vacuum cleaner, which may be retrofitted with refuse holder 10, for example. Refuse holder 10 includes a collector unit 12 for collection of refuse from air entrained with refuse as the air is moved through the collector unit via first air inlet means and air outlet means on configuration of the refuse holder in a vacuuming mode. Refuse holder 10 further includes a storage unit 14 connectable to collector unit 12 by second outlet means for storage of a plurality of batches of collected refuse from the collector unit. Each batch of refuse collected with collector unit 12 becomes transferable to the storage unit 14 on configuration of refuse holder 10 in a refuse transfer mode. Refuse holder 10 yet further includes means for switching the configuration of the refuse holder between the vacuuming mode and the refuse transfer mode.

In the embodiment illustrated in FIG. 1, collector unit 12 includes an inner wall 16 and an outer wall 18 surrounding inner wall 16. In the embodiment shown, inner wall 16 and outer wall 18 are annular, although alternatively, inner wall 16 and outer wall 18 may have different configurations. Collector unit 12 further includes a lower end wall 20 extending between inner wall 16 and outer wall 18. Inner wall 16, outer wall 18, and end wall 20 cooperate to define an external annular chamber 22 for collecting at least some refuse introduced by air entering collector unit 12 through first air inlet means.

In the embodiment shown, outer wall 18 defines the first air inlet means for receiving air entrained with refuse, i.e. first air inlet 24, while inner wall 16 defines the air outlet means for removing air from collector unit 12, i.e. air outlet 26, when the refuse holder is in the vacuuming mode. In this embodiment, the first air inlet means are configured to impart cyclonic air flow in collector unit 12 when air passes through the first air inlet means. For example, first air inlet 24 may direct air tangentially into collector unit 12, in order to impart cyclonic air flow. In this embodiment, first air inlet means consist of a single opening, i.e. first air inlet 24, however, a person of ordinary skill in the art will appreciate that first air inlet means may include a plurality of openings. In addition, a series of protruding fins 25 formed on inner wall 16 serve to generate downward, rotary air flow within external annular chamber 22 to allow refuse to collect on end wall 20.

Outer wall 18 further defines the refuse outlet means, i.e. refuse outlet 28, for transfer of collected refuse from collector unit 12 to storage unit 14 when the refuse holder is in the refuse transfer mode. However, those ordinarily skilled in the art will appreciate that the primary inlet means and refuse outlet means could be defined by any one or more of inner wall 16, outer wall 18, and end wall 20.

In the embodiment shown, air outlet 26 is defined by a plurality of openings in an enlarged radius upper portion of inner wall 16. However, in alternative embodiments, air outlet 26 may be defined by any one or more of inner wall 16, outer wall 18, and end wall 20 for example, and may include any number of openings.

Figure 3:
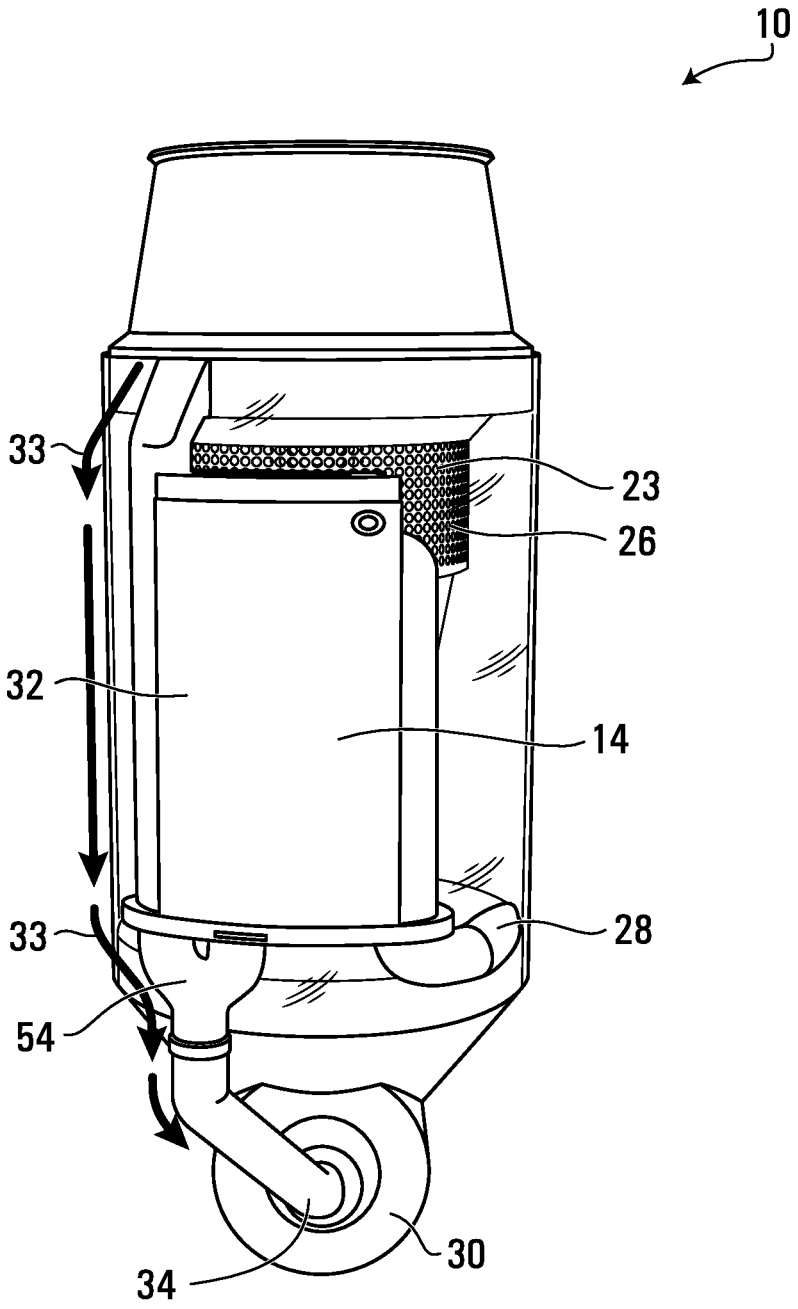
FIG. 3 is a side view of the vacuum cleaner refuse holder of FIG. 1 in vacuuming mode.

In operation, air entrained with refuse collected at the main inlet of the vacuum cleaner passes through first air inlet 24 and enters collector unit 12. At least some of the entrained refuse is deposited in external annular chamber 22 of collector unit 12, and air exits collector unit 12 through air outlets 26 and into an internal chamber 23. Referring to FIG. 3, internal chamber 23 is in communication with suction source 30, a vacuum motor fan, for example, through conduit 32, such that air is drawn from the internal chamber 23 through conduit 32 to suction source inlet 34 as shown by arrows 33.

Prior to exiting internal chamber 23 through conduit 32, fine refuse that passed through air outlets 26 can be further separated from the air by means known in the art. For example, additional filters (not shown) may be positioned to treat the air before reaching suction source 30. Instead of filters or in addition thereto, internal chamber 23 may include at least one cyclone unit 36 as disclosed in U.S. Pat. No. 4,593,429. Fine refuse may thereby be collected within the internal chamber based on the action of the cyclone units 36 resulting in cleaner air exiting the internal chamber through conduit 32.

Figure 3A:
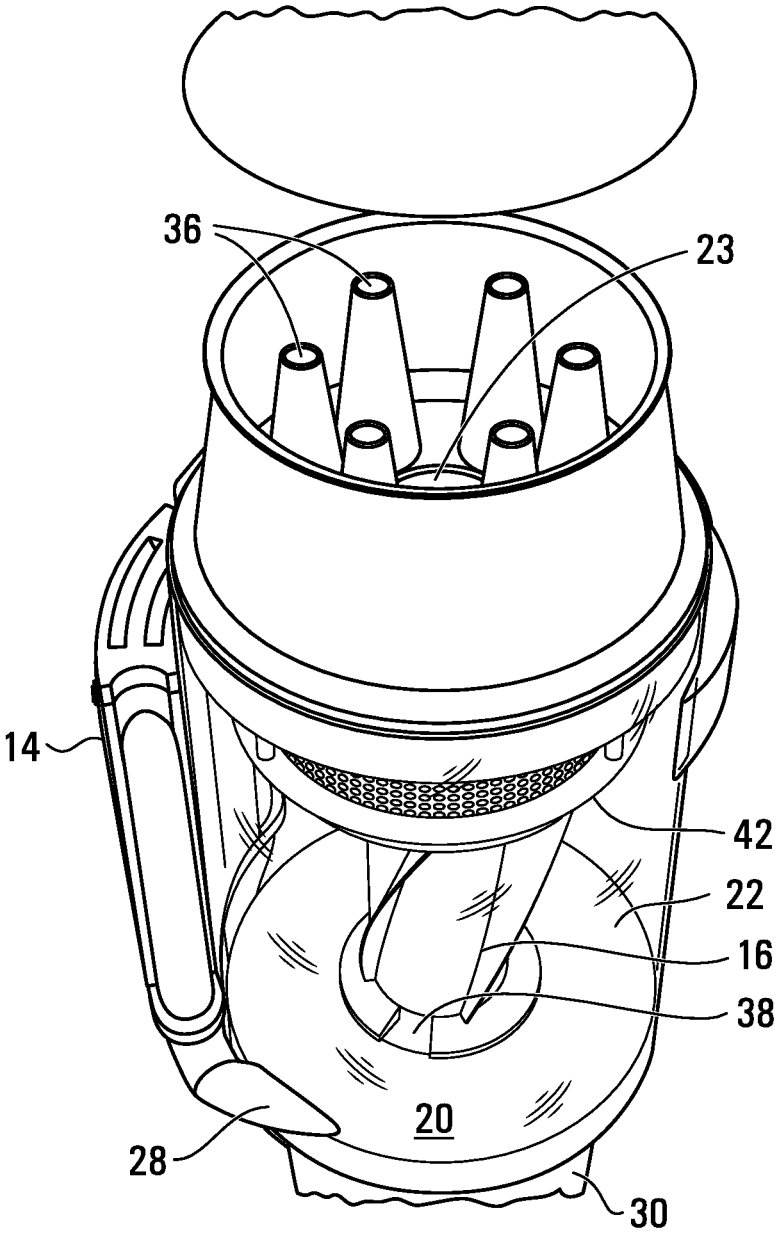
FIG. 3A is a top view with removed portions showing cyclones for additional cleaning.

By way of example, FIG. 3A shows an exemplary construction of a cyclone arrangement within internal chamber 23. FIG. 3A shows the top of refuse holder 10 removed to reveal a plurality of inverted cyclones 36. Air laden with fine refuse from air outlets 26 is drawn through the cyclones in a known manner such that much of the fine refuse is extracted from the air by cyclonic action prior to the air being withdrawn through conduit 32. This can lead to accumulation of fine refuse within internal chamber 23.

Collector unit 12 may further include additional air inlet means for receiving air when refuse holder 10 is configured in the refuse transfer mode. In the embodiment shown, for example, collector unit 12 includes selectively sealable second air inlet 38 defined by inner wall 16 and end wall 20 for receiving air in external chamber 22 from internal 23 chamber when the refuse holder 10 is in the refuse transfer mode. Second air inlet 38 is sealed shut when refuse holder 10 is in vacuum mode. Second air inlet 38 is in fluid communication with internal chamber 23 and may be adapted to open when refuse holder 10 is in the refuse transfer mode such that fine refuse collected in the internal chamber, by cyclone units 36, for example, may be urged by air flow through the second air inlet 38, into external chamber 22, and then into storage unit 14 via refuse outlet 28. To minimize residence time of the fine refuse in external chamber 22, refuse outlet 28 and second air inlet 38 are positioned adjacent each other.

Figure 2:
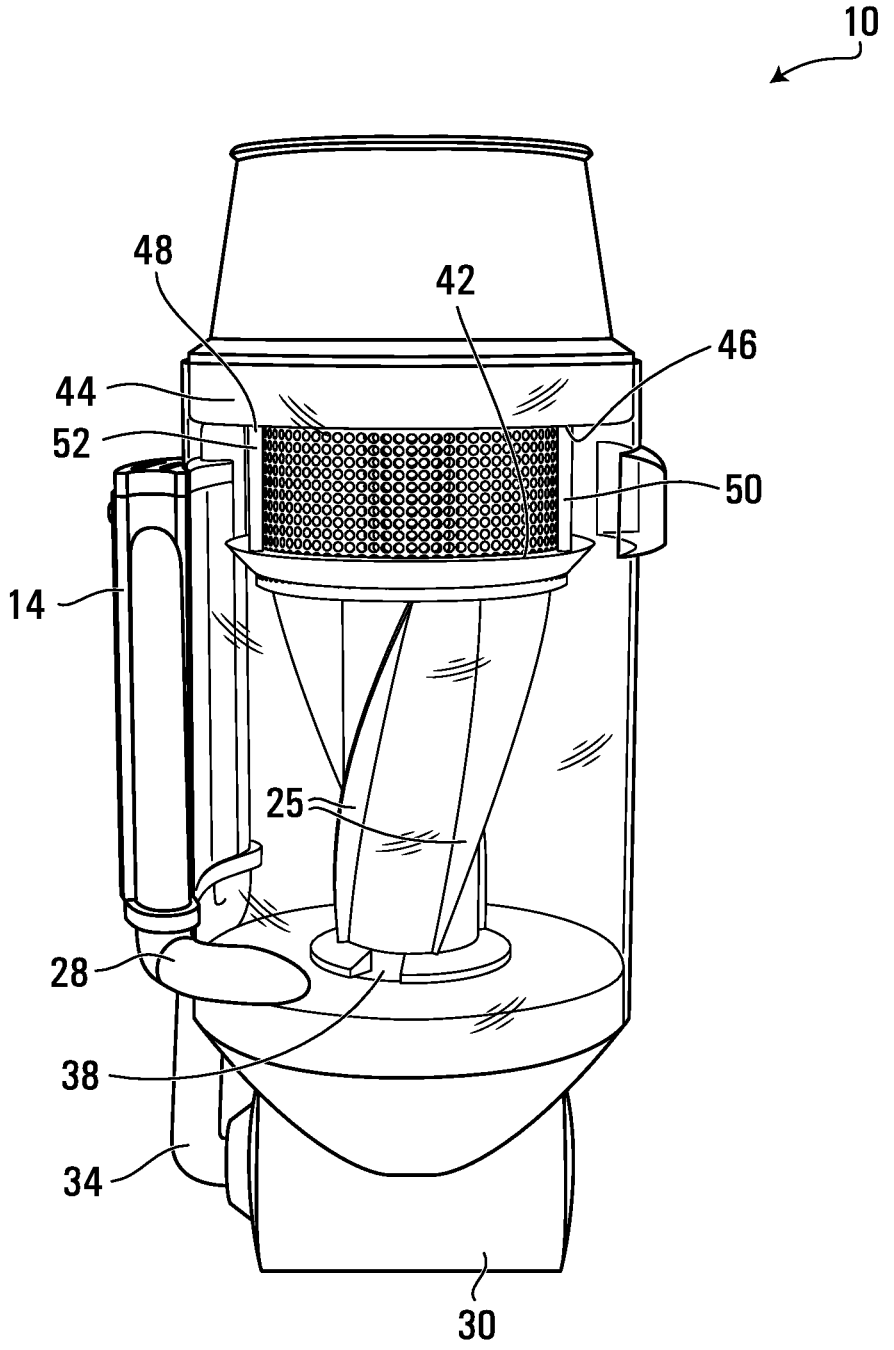
FIG. 2 is a front view of the refuse holder of FIG. 1, showing the scraper in a second position.

As best shown in FIGS. 1 and 2, collector unit 12 further includes a scraper 40 having an inner margin 42 in slidable contact with inner wall 16. Scraper 40 is annular to contact the upper portion of annular inner wall 16, although alternatively, scraper 40 may have any configuration whereby inner margin 42 is in slidable contact with inner wall 16. A person of ordinary skill in the art will understand, however, that a scraper may have an outer margin in contact with the outer wall in embodiments where the air outlet means are defined by the outer wall.

Still referring to FIG. 1, scraper 40 is illustrated in a first upper position adjacent the top of chamber 22, wherein air inlet 24 is located between the scraper 40 and end wall 20. Scraper 40 is moveable between the first position illustrated in FIG. 1, and a second position spaced apart from the first position towards end wall 20, as illustrated in FIG. 2. Refuse holder 10 as described herein may provide numerous advantages over known refuse holders. In the embodiment shown, scraper 40 is moved past air outlets 26 when travelling from the first position illustrated in FIG. 1 to the second position illustrated in FIG. 2 or in the opposite direction. Advantageously, refuse that may be trapped in air outlets 26, may thus be urged out of air outlets 26 and into chamber 22. This arrangement may advantageously prevent refuse collected near air outlets 26 from obstructing air flow through air outlets 26, and collecting in filters (not shown) downstream from air outlet 26, or from passing through such filters and entering ambient air surrounding the vacuum cleaner.

Referring to FIG. 2, collector unit 12 further includes a flange 44 coupled to inner wall 16, and defining a plurality of threaded openings 46 and 48 spaced apart around flange 44. Collector unit 12 also includes a plurality of threaded shafts 50 and 52 extending through threaded openings 46 and 48, respectively, to engage scraper 40. Thus, coordinated rotation of threaded shafts 50 and 52 by an electric motor (not shown), for example results in movement of scraper 40 relative to flange 44 and air outlet 26, between the first and second positions illustrated in FIGS. 1 and 2, respectively.

Additional schemes may be employed to move scraper 40 between the first and second positions. For example, magnetic or electromagnetic fields, positive and negative air pressure, motorized extendable and retractable telescoping rods, compression and extension spring combinations, a stationary round or cog gear driving a square rod with mating gears, hydraulics, and pneumatics may be included in alternative embodiments to move scraper 40 between the first and second positions.

Referring to FIGS. 1 to 3, refuse holder 10 further includes storage unit 14 adjacent collector unit 12, for receiving collected refuse transferred from collector unit 12 through refuse outlet 28 when refuse holder 10 is switched from the vacuuming mode to the refuse transfer mode. Thus, in this embodiment, with refuse holder 10 in refuse transfer mode, vacuum motor fan causes air to flow from collector unit 12 through refuse outlet 28 and into storage unit 14, whereby refuse collected in the collector unit 12 is transferred in a batch by the air through the second outlet 28 and into the storage unit 14. Storage unit 14 may be removable from the refuse holder. Storage unit 14 may be a bagless storage container, or may employ a removable insert for storage of the batches of collected refuse such as an air-permeable bag. Storage unit 14 is in communication with suction source 30 through storage unit outlet 54, such that clean air is drawn from storage unit 14 through storage unit outlet 54 to suction source inlet 34.

Figure 4:
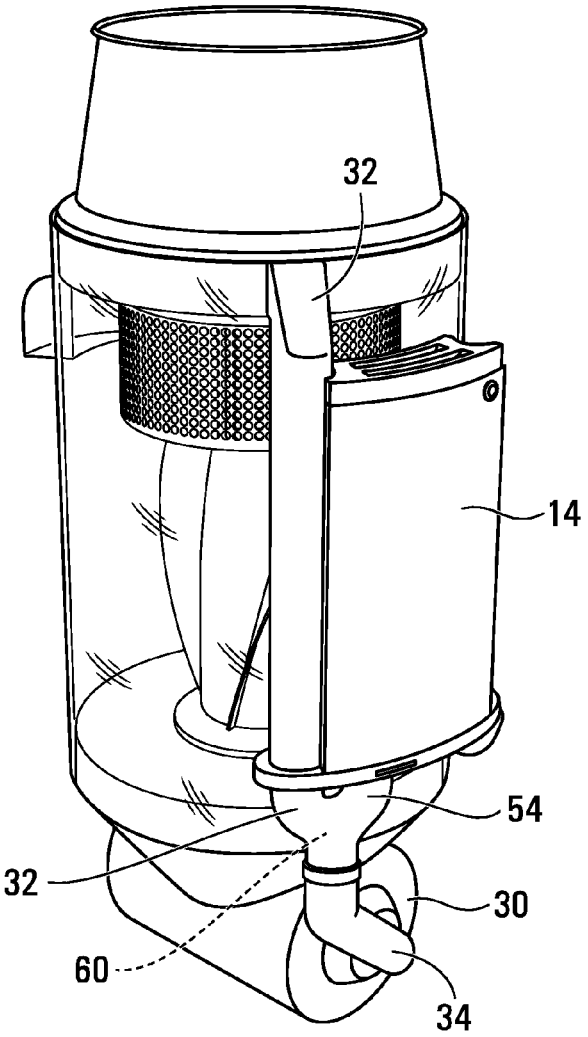
FIG. 4 is a rear view of the vacuum cleaner refuse holder of FIG. 1 in showing equipment for transfer between vacuuming mode and refuse transfer mode.
Figure 4A:
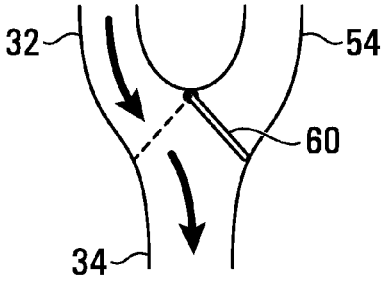
FIG. 4A is a schematic view of a valve arrangement in vacuuming mode.
Figure 4B:
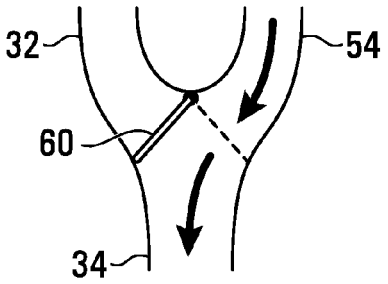
FIG. 4B is a schematic view of a valve arrangement in refuse transfer mode.

Referring to FIGS. 4 to 4B, in the embodiment shown, means for switching the configuration of the refuse holder between vacuuming mode and refuse transfer mode include valve member 60 moveable between a first position illustrated schematically in FIG. 4A in which conduit 32 is in fluid communication with suction source inlet 34 while valve member 60 occludes storage unit outlet 54, and a second position illustrated schematically in FIG. 4B in which storage unit outlet 54 is in fluid communication with vacuum fan inlet suction source inlet 34 while valve member 60 occludes conduit 32. Accordingly, refuse holder 10 is in vacuuming mode when valve member 60 is in the first position and in refuse transfer mode when valve member 60 is in the second position. Refuse holder 10 may be switched between vacuuming mode and refuse transfer mode several times as refuse accumulates in collector unit 12 such that a plurality of batches is received by storage unit 14 from collector unit 12. When storage unit 14 is filled with refuse received from collector unit 12, storage unit 14 may be removed from refuse holder 10 to be emptied or replaced.

Figure 5:
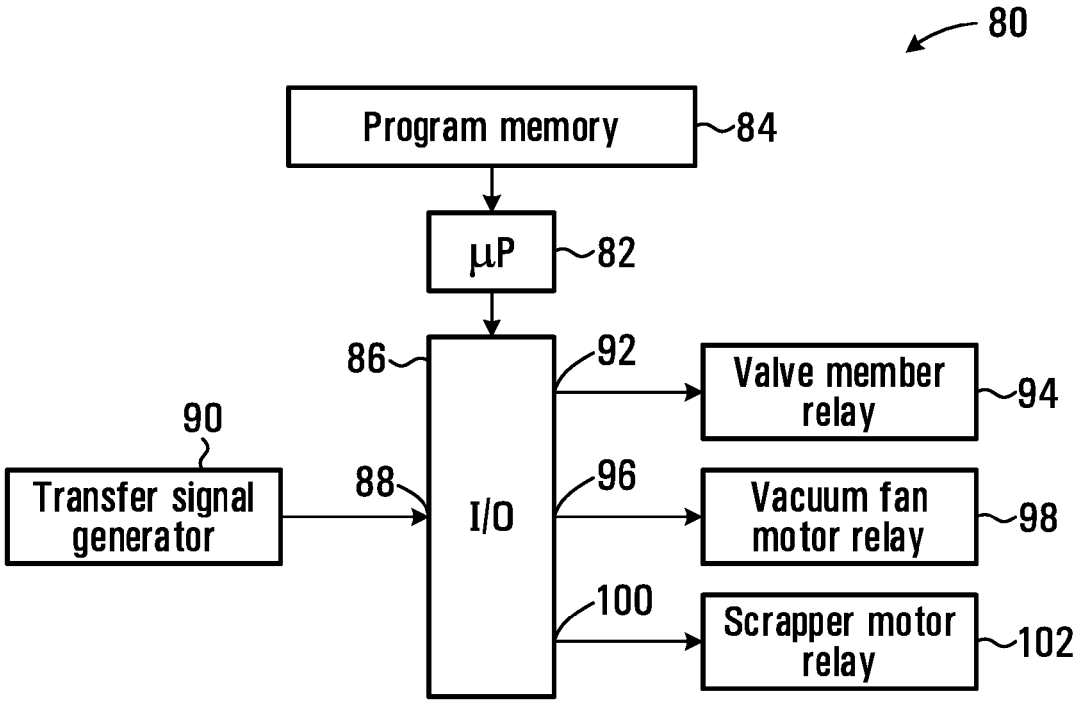
FIG. 5 is a schematic illustration of a processor circuit of the vacuum cleaner of FIG. 1.

Referring to FIG. 5, a processor circuit for controlling the refuse holder 10 is illustrated generally at 80. Processor circuit 80 includes a microprocessor 82, and a program memory 84 and input/output ("I/O") 86, both in communication with microprocessor 82. Program memory 84 is a computer-readable medium, as well-known in the art, encoded with codes for directing microprocessor 82 to carry out various functions of vacuum cleaner 10. I/O 86 includes a transfer signal generator port 88 for receiving signals from a transfer signal generator 90. I/O 86 also includes valve member relay port 92 for sending signals to a valve member relay 94 for controlling the movement of valve member 60 between the first and second positions illustrated in FIGS. 3 and 4. I/O 86 also includes a vacuum fan motor relay port 96 for sending signals to a vacuum fan motor relay 98 for controlling a vacuum fan motor (not shown) for causing air to pass through collector unit 12 and storage unit 14 (illustrated in FIGS. 1, 2, 3, and 4). I/O 86 may also include a scraper motor relay port 100 for sending signals to a scraper motor relay 102 for controlling a scraper motor (not shown) in communication with threaded shafts 50 and 52 to cause scraper 40 to move between the first and second positions (illustrated in FIGS. 1 and 2, respectively).

Figure 6:
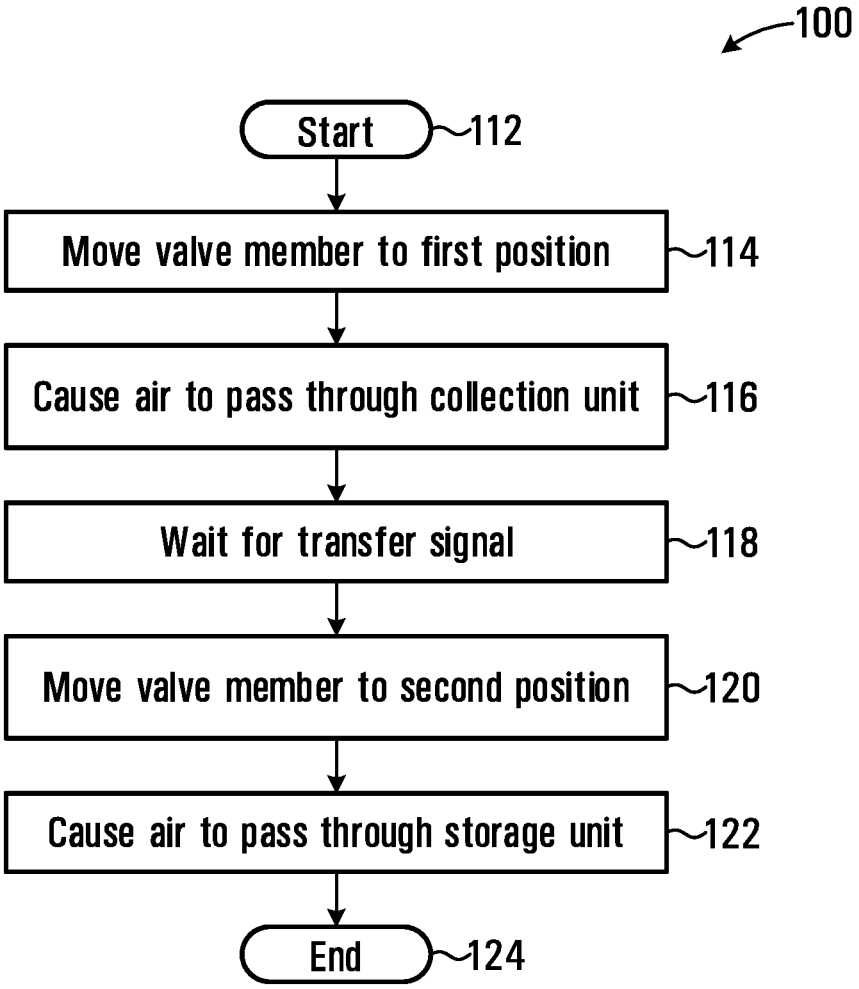
FIG. 6 is a schematic illustration of a method of operating the refuse holder of FIG. 1, in accordance with another embodiment of the invention.

Referring to FIG. 6, a method of operating refuse holder 10 in accordance with one embodiment of the invention is shown generally at 110. FIG. 6 illustrates blocks of code generally for directing processor circuit 80 to carry out method 110, and these blocks of code are stored in program memory 84 illustrated in FIG. 5. Processor circuit 80 is thus configured to carry out method 110. Alternatively, method 110 may be carried out manually, implemented by any known technique for automating method 110, or any combination thereof.

Method 110 begins at 112, in response to user actuation of an "on" switch (not shown) or "start" button (not shown) of the vacuum cleaner, for example, or alternatively any manual or automated indication to begin collecting refuse. Method 110 continues at block 114, which directs microprocessor 82 to cause the valve member 60 to move to the first position (illustrated in FIG. 4A). The codes at block 114 cause I/O 86 to send a signal from valve member relay port 92 to valve member relay 94 (illustrated in FIG. 5) to cause valve member 60 to move to the first position (illustrated in FIG. 4A).

Method 110 continues at block 116, which directs microprocessor 82 to cause air, typically entrained with refuse, to pass through first air inlet 24 and into collector unit 12. In the illustrated embodiment, the codes at block 116 cause microprocessor 82 to generate a signal at vacuum fan motor relay port 96 to cause vacuum fan motor relay 98 (illustrated in FIG. 5) to cause a vacuum fan motor (not shown) to rotate a fan (not shown), thereby creating a vacuum suction source to draw air from an inlet region (not shown) of vacuum cleaner, through first air inlet 24, into external chamber 22 of collector unit 12, out through air outlet 26 and through conduit 32 to suction source inlet 34. External chamber 22 is configured to retain at least some of the refuse that is entrained in the air in the collector unit in a manner known in the art.

Method 110 continues at block 118, which directs microprocessor 82 to wait for a transfer signal to be generated by transfer signal generator 90 and received at transfer signal generator port 88 (shown in FIG. 5). In the embodiment shown, the transfer signal is generated when a user actuates a transfer button or switch (not shown) although alternatively, the transfer signal may be generated by a timing function of the microprocessor 82, or by one or more "fullness" indicators, for example.

Method 110 continues at block 120, which directs microprocessor 82 to cause valve member 60 to move to the second position (illustrated in FIG. 4B). The codes at block 120 cause I/O 86 to send a signal from valve member relay port 92 to valve member relay 94 (illustrated in FIG. 5) to cause valve member to move to the second position (illustrated in FIG. 4B). Method 110 continues at block 122 whereby suction source 30 draws air from the collector unit 12 through refuse outlet 28, into storage unit 14, out through storage unit outlet 54 and to suction source inlet 34. Storage unit 14 is configured to store all of the refuse that is entrained in the air in the collector unit in a manner known in the art. In some embodiments, microprocessor 82 may cause the vacuum fan motor (not shown) that creates suction at inlet region (not shown) to cease temporarily before executing the codes of block 120. However, it will be appreciated that ceasing operation of the vacuum fan motor during this stage is not essential for operation of vacuum cleaner 10.

Referring back to FIG. 6, method 110 then ends at block 124, although it will be appreciated that method 110 may be repeated as desired in order to effect a continuing cleaning function of vacuum cleaner 10.

Figure 7:
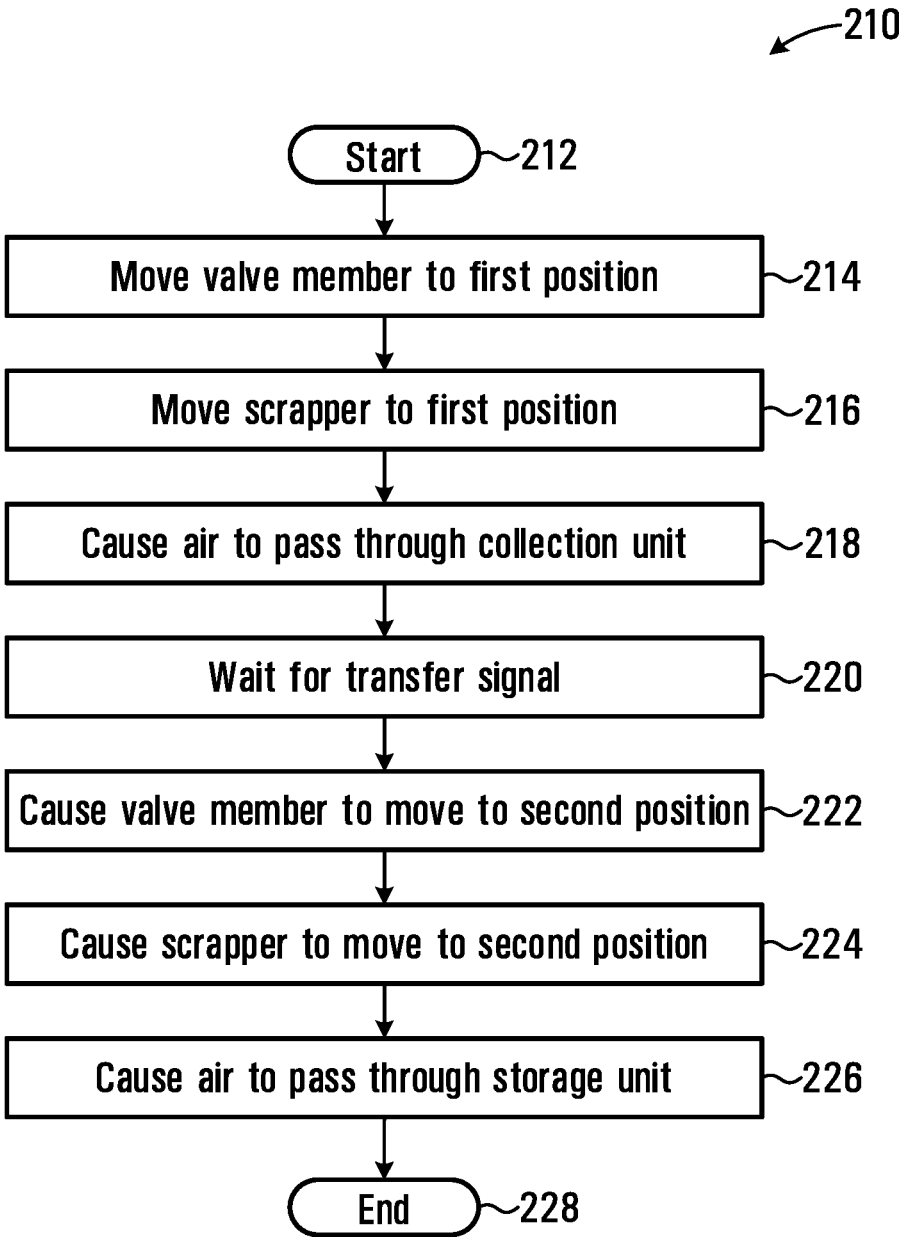
FIG. 7 is a schematic illustration of a method of operating the refuse holder of FIG. 1, in accordance with another embodiment of the invention.

Referring to FIG. 7, a method of operating refuse holder 10 in accordance with another embodiment of the invention utilizing scraper 40 is shown generally at 210. FIG. 7 illustrates blocks of code generally for directing processor circuit 80 to carry out method 210, and these blocks of code are stored in program memory 84 illustrated in FIG. 5. Processor circuit 80 is thus configured to carry out method 210. Alternatively, method 210 may be carried out manually, implemented by any known technique for automating method 210, or any combination thereof.

Method 210 begins at 212, in response to user actuation of an "on" switch (not shown) or "start" button (not shown) of the vacuum cleaner, for example, or alternatively any manual or automated indication to begin collecting refuse. Method 210 continues at block 214, which directs microprocessor 82 to cause the valve member 60 to move to the first position (illustrated in FIG. 4A). The codes at block 214 cause I/O 86 to send a signal from valve member relay port 92 to valve member relay 94 (illustrated in FIG. 5) to cause valve member 60 to move to the first position (illustrated in FIG. 3).

Method 210 continues at block 216, which directs microprocessor 82 to cause scraper 40 to move to the first position (illustrated in FIG. 1). The codes at block 216 cause I/O 86 to send a signal from scraper motor relay port 100 to scraper motor relay 102 (illustrated in FIG. 5) to cause scraper 40 to move to the first position (illustrated in FIG. 1).

Method 210 continues at block 218, which directs microprocessor 82 to cause air, typically entrained with refuse, to pass through first air inlet 24 and into collector unit 12. In the illustrated embodiment, the codes at block 218 cause microprocessor 82 to generate a signal at vacuum fan motor relay port 96 to cause vacuum fan motor relay 98 (illustrated in FIG. 5) to cause a vacuum fan motor (not shown) to rotate a fan (not shown), thereby creating a vacuum suction source to draw air from an inlet region (not shown) of vacuum cleaner, through first air inlet 24, into external chamber 22 of collector unit 12, out through air outlet 26 and through conduit 32 to suction source inlet 34. External chamber 22 is configured to retain at least some of the refuse that is entrained in the air in the collector unit in a manner known in the art.

Method 210 continues at block 220, which directs microprocessor 82 to wait for a transfer signal to be generated by transfer signal generator 90 and received at transfer signal generator port 88 (shown in FIG. 5). In the embodiment shown, the transfer signal is generated when a user actuates a transfer button or switch (not shown) although alternatively, the transfer signal may be generated by a timing function of the microprocessor 82, or by one or more "fullness" indicators, for example.

Method 210 continues at block 222, which directs microprocessor 82 to cause valve member 60 to move to the second position (illustrated in FIG. 4B) and thereby switch the vacuum cleaner. The codes at block 84 cause I/O 86 to send a signal from valve member relay port 92 to valve member relay 94 (illustrated in FIG. 5) to cause valve member to move to the second position (illustrated in FIG. 4B). Method 210 continues at block 226 whereby suction source 30 draws air from the collector unit 12 through refuse outlet 28, into storage unit 14, out through storage unit outlet 54 and to suction source inlet 34. Storage unit 14 is configured to store all of the refuse that is entrained in the air in the collector unit in a manner known in the art. In some embodiments, microprocessor 82 may cause the vacuum fan motor (not shown) that creates suction at inlet region (not shown) to cease temporarily before executing the codes of block 222. However, it will be appreciated that ceasing operation of the vacuum fan motor during this stage is not essential for operation of vacuum cleaner 10.

Method 210 continues at block 224, which directs microprocessor 82 to cause scraper 40 to move to the second position (illustrated in FIG. 2). The codes at block 224 cause I/O 86 to send a signal from scraper motor relay port 100 to scraper motor relay 102 (illustrated in FIG. 5) to cause scraper 40 to move to the second position (illustrated in FIG. 2). Again, microprocessor 82 may cause the vacuum fan motor (not shown) that creates suction at inlet region (not shown) to cease temporarily before executing the codes of block 224. However, it will be appreciated that ceasing operation of the vacuum fan motor during this stage is not essential for operation of vacuum cleaner 10. It will further be appreciated that the codes block 224 may be executed elsewhere during the performance of the general method, and may be executed while the refuse holder is in vacuum mode or in refuse transfer mode, or both.

Referring back to FIG. 7, method 210 then ends at block 228, although it will be appreciated that method 210 may be repeated as desired in order to affect a continuing cleaning function of vacuum cleaner.

While specific embodiments of the invention have been described and illustrated, such embodiments should be considered illustrative of the invention only and not as limiting the invention as construed in accordance with the accompanying claims.

What is claimed is:

1. A refuse holder for holding refuse in a vacuum cleaner comprising a suction source, the refuse holder comprising:

a collector unit for collection of refuse from air entrained with refuse as the air is moved through the collector unit by the suction source via an air inlet and an air outlet on configuration of the refuse holder in a vacuuming mode, said collector unit retaining the refuse as a batch of collected refuse;

a storage unit mounted to the collector unit and in communication with the collector unit by a refuse outlet, the storage unit being adapted to store a plurality of batches of collected refuse from the collector unit, each batch being transferrable to the storage unit on configuration of the refuse holder in a refuse transfer mode; and a valve member for switching the configuration of the refuse holder between vacuuming mode and refuse transfer mode, the valve member being in communication with the suction source, and the valve member being movable between a first position for vacuuming mode communicating the suction source with the collector unit to generate a first air flow from external to the refuse holder through the collector unit via the air inlet and the air outlet, and a second position for refuse transfer mode communicating the suction source with the storage unit to generate a second air flow through the refuse outlet.

2. The refuse holder of claim 1 in which the storage unit includes a removable insert for storage of the batches of collected refuse.

3. A vacuum cleaner having a refuse holder according to claim 1.

4. The refuse holder of claim 1 in which the collector unit comprises:

an inner wall;

an outer wall surrounding the inner wall; and an end wall extending between the inner and outer walls;

wherein at least one of the inner wall, the outer wall, and the end wall defines the air inlet for receiving the air entrained with refuse when the refuse holder is in the vacuuming mode;

wherein at least one of the inner wall, the outer wall, and the end wall, defines the air outlet for removing the air from the collector unit when the refuse holder is in the vacuuming mode; and wherein at least one of the inner wall, the outer wall, and the end wall, defines the refuse outlet for transfer of each batch of collected refuse from the collector unit to the storage unit when the refuse holder is in the refuse transfer mode.

5. The refuse holder of claim 1 in which the collector unit includes an internal region having at least one cyclone unit.

6. A refuse holder for holding refuse in a vacuum cleaner comprising:

a collector unit for collection of refuse from air entrained with refuse as the air is moved through the collector unit via an air inlet and an air outlet on configuration of the refuse holder in a vacuuming mode, said collector unit retaining the refuse as a batch of collected refuse;

a storage unit mounted to the collector unit and in communication with the collector unit by a refuse outlet, the storage unit being adapted to store a plurality of batches of collected refuse from the collector unit, each batch being transferrable to the storage unit on configuration of the refuse holder in a refuse transfer mode; and a valve member for switching the configuration of the refuse holder between vacuuming mode and refuse transfer mode, the valve member being in communication with a suction source, and the valve member being movable between a first position for vacuuming mode communicating the suction source with the collector unit to generate a first air flow from external to the refuse holder through the collector unit via the air inlet and the air outlet, and a second position for refuse transfer mode communicating the suction source with the storage unit to generate a second air flow through the refuse outlet;

wherein the collector unit further comprises:

an inner wall;

an outer wall surrounding the inner wall; and an end wall extending between the inner and outer walls;

wherein at least one of the inner wall, the outer wall, and the end wall defines the air inlet for receiving the air entrained with refuse when the refuse holder is in the vacuuming mode;

wherein at least one of the inner wall, the outer wall, and the end wall, defines the air outlet for removing the air from the collector unit when the refuse holder is in the vacuuming mode; and wherein at least one of the inner wall, the outer wall, and the end wall, defines the refuse outlet for transfer of each batch of collected refuse from the collector unit to the storage unit when the refuse holder is in the refuse transfer mode.

7. The refuse holder of claim 6 wherein the inner and outer walls are annular.

8. The refuse holder of claim 6 wherein the air inlet is defined by at least one opening in the outer wall.

9. The refuse holder of claim 6 wherein the air inlet is configured to impart cyclonic flow in the refuse collector when air passes through the air inlet.

10. The refuse holder of claim 6 wherein at least one of the inner wall, the outer wall, and the end wall, defines an additional air inlet for receiving air when the refuse holder is configured in refuse transfer mode.

11. The refuse holder of claim 6 further comprising a scraper having an inner margin and an outer margin, wherein the inner margin is in slidable contact with the inner wall and the inner wall defines the air outlet, and wherein the scraper is movable over the air outlet to clean the air outlet.

12. The refuse holder of claim 11 further comprising a flange coupled to the inner wall defining a plurality of threaded openings; and a plurality of threaded shafts rotatably attached to the scraper and extending through respective said threaded openings and engaging with the refuse holder, whereby coordinated rotation of the threaded shafts results in movement of the scraper with respect to the air outlet means.

13. The refuse holder of claim 11 comprising:

at least one rod coupled to the scraper, the rod having ends proximal and distal to the end wall, and the distal end extends away from the scraper;

a connector coupled to the distal end, the connector further defining a threaded opening; and a threaded shaft coupled to the at least one rod by the connector and extending through the threaded opening and engaging with the refuse holder, whereby rotation of the threaded shaft results in movement of the scraper with respect to the air outlet.

14. The refuse holder of claim 6 wherein the air outlet is defined by at least one opening in the inner wall.

15. A refuse holder for holding refuse in a vacuum cleaner comprising:

a collector unit for collection of refuse from air entrained with refuse as the air is moved through the collector unit via an air inlet and an air outlet on configuration of the refuse holder in a vacuuming mode, said collector unit retaining the refuse as a batch of collected refuse and including an internal region having at least one cyclone unit;

a storage unit mounted to the collector unit and in communication with the collector unit by a refuse outlet, the storage unit being adapted to store a plurality of batches of collected refuse from the collector unit, each batch being transferrable to the storage unit on configuration of the refuse holder in a refuse transfer mode; and a valve member for switching the configuration of the refuse holder between vacuuming mode and refuse transfer mode, the valve member being in communication with a suction source, and the valve member being movable between a first position for vacuuming mode communicating the suction source with the collector unit to generate a first air flow from external to the refuse holder through the collector unit via the air inlet and the air outlet, and a second position for refuse transfer mode communicating the suction source with the storage unit to generate a second air flow through the refuse outlet.

16. The refuse holder of claim 15 in which the internal region includes a sealable outlet adapted to open when the refuse holder is in the refuse transfer mode to permit removal of refuse from the internal region of the collector unit.

17. The refuse holder of claim 6 in which the inner wall and the outer wall define a first chamber of the collector unit for cyclonic air flow with the air inlet formed on the outer wall and the air outlet formed on the inner wall to communicate with a second chamber having at least one cyclone unit to receive air and an additional air outlet from the second chamber.

18. A refuse holder for holding refuse in a vacuum cleaner, the refuse holder comprising:

a collector unit including:

a first inner wall;

an outer wall surrounding the inner wall; and an end wall extending between the inner and outer walls;

wherein at least one of the first inner wall, the outer wall, and the end wall defines an air inlet for receiving air entrained with refuse, said collector unit being adapted to collect said refuse as a batch of collected refuse when the refuse holder is in a vacuuming mode;

wherein at least one of the first inner wall, the outer wall, and the end wall, defines an air outlet for removing the air from the collector unit when the refuse holder is in the vacuuming mode;

wherein at least one of the first inner wall, the outer wall, and the end wall, defines a refuse outlet for removing the batch of collected refuse from the collector unit when the refuse holder is in a refuse transfer mode;

a storage unit in communication with the refuse outlet for receiving the batch of collected refuse from the collector unit when the refuse holder is in the refuse transfer mode, and being adapted for storing a plurality of batches of collected refuse; and a valve member in communication with a suction source, the valve member being movable between a first position for vacuuming mode communicating the suction source with the collector unit to generate a first air flow from external to the refuse holder through the collector unit via the air inlet and the air outlet, and a second position for refuse transfer mode communicating the suction source with the storage unit to generate a second air flow through the refuse outlet.

* * * * *